US006036039A

United States Patent [19]

Ki

[11] Patent Number: 6,036,039

[45] Date of Patent: Mar. 14, 2000

[54] TEMPERATURE DISTRIBUTION EQUALIZING STRUCTURE IN HEAT ROLLER OF AN IMAGE FORMING DEVICE SUCH AS A LASER PRINTER

[75] Inventor: Dae-Hong Ki, Kyungki-do, Rep. of Korea

[73] Assignee: SamSung Electronics Co., Ltd., Kyungki-do, Rep. of Korea

[21] Appl. No.: 08/966,534

[22] Filed: Nov. 10, 1997

[30] Foreign Application Priority Data

Nov. 8, 1996 [KR] Rep. of Korea ..... 96-39158

[51] Int. Cl.[7] ..... G03G 15/20

[52] U.S. Cl. ..... 217/216; 399/331; 399/334

[58] Field of Search ..... 219/216; 399/328, 399/330, 331, 334; 347/156; 492/46; 118/60; 432/60, 228

[56] References Cited

U.S. PATENT DOCUMENTS

| | | | |
|---|---|---|---|
| 4,229,950 | 10/1980 | Fessenden | 492/46 |
| 4,607,936 | 8/1986 | Miyakawa et al. | 219/216 |
| 4,632,855 | 12/1986 | Conlon et al. | 219/216 |
| 5,221,947 | 6/1993 | Ndebi et al. | 399/330 |
| 5,649,891 | 7/1997 | Kass et al. | 492/46 |
| 5,659,848 | 8/1997 | Jeon | 399/330 |
| 5,811,759 | 9/1998 | Kosagi et al. | 219/216 |

FOREIGN PATENT DOCUMENTS

| | | |
|---|---|---|
| 62-18583 | 1/1987 | Japan . |
| 62-18584 | 1/1987 | Japan . |
| 8-328413 | 12/1996 | Japan . |

*Primary Examiner*—Joseph Pelham
*Attorney, Agent, or Firm*—Robert E. Bushnell, Esq.

[57] ABSTRACT

A temperature distribution equalizing structure of a heat roller in an image forming device such as a laser printer which is capable of preventing, in a simple manner, a decrease in the temperature on both ends of a heat roller installed in the laser printer, includes first and second through apertures respectively formed on a pair of bearings disposed on both ends of the heat roller and a gear disposed on one end of the heat roller to thereby allow a halogen lamp to pass therethrough such that the remaining portions of the bearings and the gear are each closed, for preventing a decrease in temperature on both ends of the heat roller and for simultaneously preventing the halogen lamp from being inclined on an interior of the heat roller.

6 Claims, 2 Drawing Sheets

TEMPERATURE DISTRIBUTION EQUALIZING STRUCTURE IN HEAT ROLLER OF AN IMAGE FORMING DEVICE SUCH AS A LASER PRINTER

CLAIM OF PRIORITY

This application makes reference to, incorporates the same herein, and claims all benefits accruing under 35 U.S.C. §119 from an application for TEMPERATURE DISTRIBUTION EQUALIZING STRUCTURE IN HEAT ROLLER OF A LASER BEAM PRINTER earlier filed in the Korean Industrial Property Office on the $8^{th}$ of November 1996 and there duly assigned Serial No. 39158/1996.

BACKGROUND OF THE INVENTION

1. Field of the Invention

The present invention relates to a temperature distribution equalizing structure of a heat roller in a an image forming device such as a laser printer, and more particularly, to a temperature distribution equalizing structure which is capable of preventing, in a simple manner, the temperature on the both ends of a heat roller installed in an image forming device such as a laser printer from being decreased.

2. Description of the Related Art

Generally, a laser printer receives data outputted from a personal computer and outputs the received data as an image. Next, the image, which is formed on paper developed by means of an OPC drum, is fixed by scattering toner on the paper, while passing through a fixing unit. The fixing unit is divided into a heat roller which generates a high temperature and pressure portion which its made of a specific rubber material to apply pressure.

In an earlier laser printer in which a heat roller is installed, there are provided a pair of bearings which are formed on both ends of the heat roller to support the heat roller and a gear which is installed on one end of the heat roller to transmit mechanical power to the heat roller.

In the earlier laser printer, however, since the both ends of the heat roller are open, there occurs a problem in that a great amount of heat loss occurs. It can be appreciated that a temperature difference between the central portion and the left and right end portions of the earlier heat roller is great. This temperature difference results in different toner fixing states between the central portion and the left and right end portions. In other words, the central portion of the heat roller obtains a good fixing state because of its high temperature, and to the contrary, the left and right end portions of the heat roller fail to obtain such a good fixing state, when compared with the central portion.

Moreover, in the earlier laser printer, an erect rod is adapted to support a halogen lamp. In this case, as the halogen lamp is inclined gradually, the surface of the heat roller fails to maintain a uniform temperature distribution. Furthermore, in the case where an additional member is used to support both ends of the halogen lamp, the production cost and the assembling time must be increased, and therefore, the production yield may be decreased.

SUMMARY OF THE INVENTION

Accordingly, the present invention is directed to a temperature distribution equalizing structure of a hear roller in an image forming device such as a laser printer that substantially obviates one or more of the problems due to limitations and disadvantages of the related art.

An object of the invention is to provide a temperature distribution equalizing structure of a heat roller in an image forming device such as a laser printer which is capable of preventing decrease in temperature on both ends of the heat roller in a simple manner to greatly reduce a temperature difference between the central portion and the left and right end portions of the heat roller and also is capable of rigidly supporting a halogen lamp so as not to be inclined, without requiring an additional holding member.

To accomplish this and other objects of the present invention, there is provided a temperature distribution equalizing structure of a heat roller in an image forming device such as a laser printer, including: first and second through holes which are respectively formed on a pair of bearings disposed on both ends of the heat roller to thereby allow a halogen lamp to pass therethrough such that the remaining portions of the bearings and the gear are each closed, for preventing a decrease in temperature on both ends of the heat roller and for simultaneously preventing the halogen lamp from being inclined on the interior of the heat roller.

It is to be understood that both the foregoing general description and the following detailed description are exemplary and explanatory and are intended to provide further explanation of the invention as claimed.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF' PREFERRED EMBODIMENT

Reference will now be made in detail to the preferred embodiments of the present invention, examples of which are illustrated in the accompanying drawings.

Figure 1:
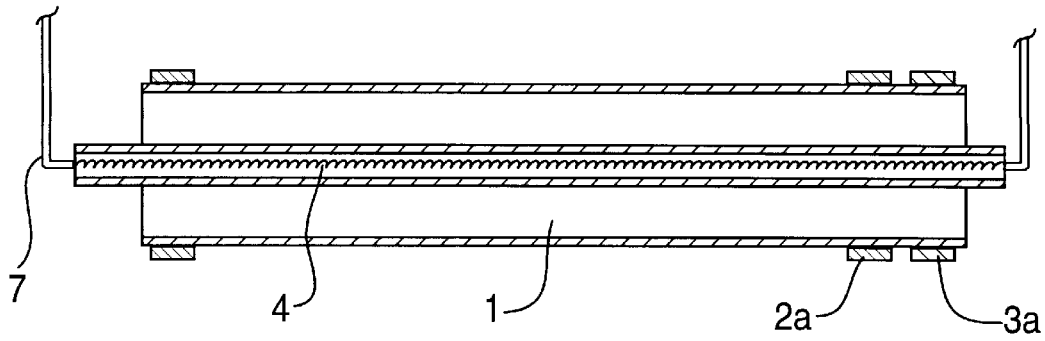
FIG. 1 RELATED ART
FIG. 1 is a longitudinal sectional view illustrating an earlier laser printer in which a heat roller is installed.

FIG. 1 is a longitudinal section view illustrating an earlier laser printer in which a heat roller 1 is installed. A pair of bearings 2*a* are formed on both ends of the heat roller to support the heat roller 1 and a gear 3*a* which is installed on one end of the heat roller 1 is used to transmit mechanical power to the heat roller 1.

In the earlier laser printer, however, since both ends of the heat roller 1 are open, there occurs a problem in that a great amount of heat loss occurs.

Figure 2:
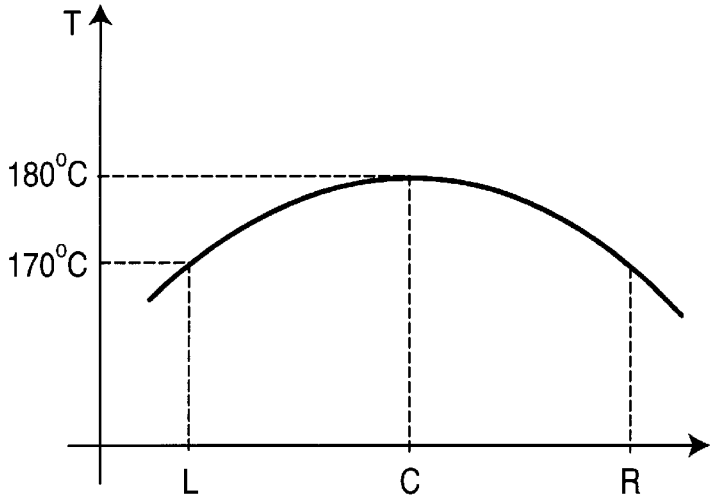
FIG. 2 RELATED ART
FIG. 2 is a graph illustrating temperature distribution according to the portion of the earlier heat roller.

As illustrated in FIG. 2, the temperature distribution along the heat roller of the earlier laser printer varies appreciably from the central portion to the left and right end portions of the earlier heat roller. This temperature difference results in different toner fixing states between the central portion and the left and right end portions.

Furthermore, in the earlier laser printer, an erect rod 7 is adapted to support a halogen lamp 4. Since the halogen lamp 4 is inclined gradually, the surface of the heat roller 1 fails to maintain a uniform heat distribution. In addition, the use of an additional member to support both ends of the halogen lamp 4 increases the production costs and assembly time and reduces the production yield.

An explanation of the construction and operation of a temperature distribution equalizing structure of a heat roller in a laser beam printer according to the present invention will be discussed with reference to FIGS. 3 to 7.

Figure 3:
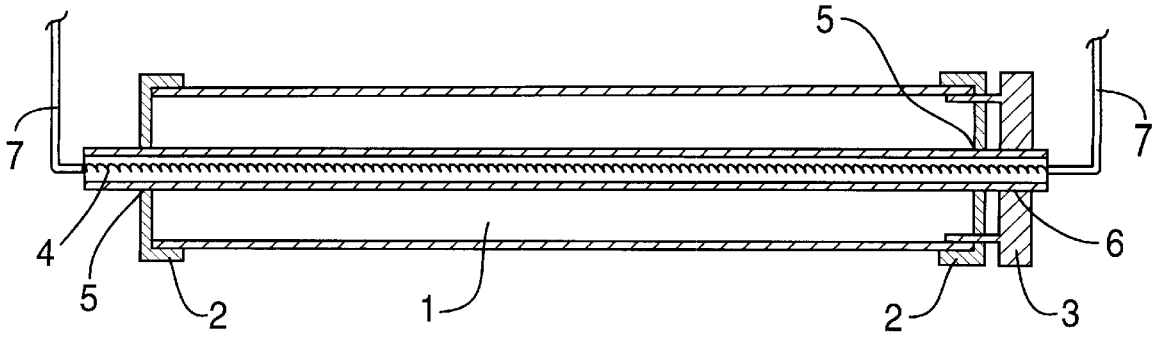
FIG. 3 is a longitudinal sectional view illustrating a laser printer in which a heat roller constructed according to the present invention is installed.
Figure 4:
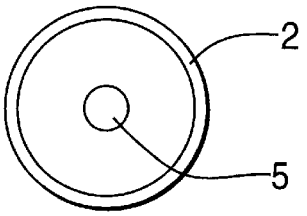
FIG. 4 is a front view illustrating a bearing of FIG. 3.
Figure 5:
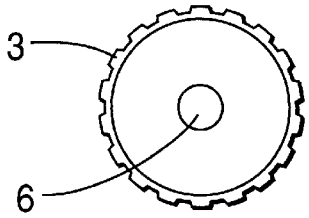
FIG. 5 is a front view illustrating a gear of FIG. 3.
Figure 6:
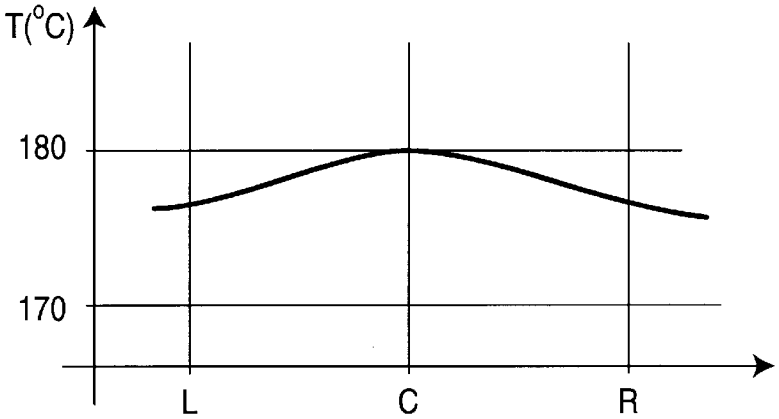
FIG. 6 is a graph illustrating the temperature distribution according to the portion of the heat roller constructed according to the present invention.
Figure 7:
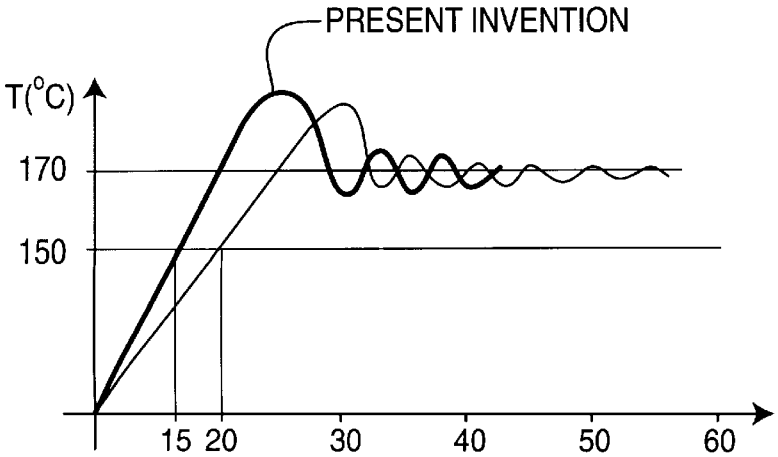
FIG. 7 is a graph illustrating a correlation relationship between time and temperature during initial driving of the laser printer according to the present invention and the earlier laser printer.

FIG. 3 is a longitudinal sectional view illustrating a laser beam printer in which a heat roller constructed according to the present invention is installed, FIG. 4 is a front view illustrating a bearing of FIG. 3, and FIG. 5 is a front view illustrating a gear of FIG. 3. Further, FIG. 6 is a graph illustrating temperature distribution according to the portion of the heat roller constructed according to the present invention, and FIG. 7 is a graph illustrating a correlation relationship between time and temperature during initial driving of the laser printer according to the present invention and the earlier laser beam printer.

In construction, a laser beam printer according to the present invention includes first and second through holes 5 and 6 which are respectively formed on a pair of bearings 2 on both ends of a heat roller 1 and a gear 3 on the one end of the heat roller 1 to thereby allow a halogen lamp 4 to pass through such that the remaining portions of the bearings 2 and the gear 3 are each closed, for preventing the temperature on both ends of the heat roller 1 from being decreased and for simultaneously preventing the halogen lamp 4 from being inclined on the interior of the heat roller 1.

Meanwhile, the first and second through holes 5 and 6 each formed on the bearings 2 and the gear 3 have a predetermined size to maintain a gap in the range of 0.5–1.5 mm between the holes and an insulator of the halogen lamp 4.

In operation, the formation of each or the first and second through holes 5 and 6 on the bearings 2 and the gear 3 prevents the temperature on both ends of the heat roller 1 from being decreased, because the ends of the heat roller 1 are closed. As shown in FIG. 6, the temperature distribution equalizing effect according to the portions of the heat roller 1 can be obtained. Therefore, since the heat loss in the interior of the heat roller 1 can be prevented, a warming up time required for an initial driving of the laser beam printer can be greatly reduced, as shown in FIG. 7.

On the other hand, it is noted that the values indicated in FIGS. 6 and 7 can be varied in accordance with a material or a diameter of the heat roller 1.

Furthermore, since the first and second through holes 5 and 6 each formed on the bearings 2 and the gear 3 have a predetermined size to maintain a gap of about 1 mm between the holes and the insulator of the halogen lamp 4, the bearings 2 and the gear 3 each serve as a holder for supporting the halogen lamp 4 passing through the heat roller 1. Therefore, in the laser printer according to the present invention, the heat roller 1 does not need any additional holding member for supporting the halogen lamp 4, to thereby reduce a production cost. Meanwhile, in the case where both ends of the halogen lamp 4 are fixed by means of an erect rod 7, the bearings 2 and the gear 3 can prevent the inclination of the halogen lamp 4 within the interior of the heat roller 1.

As clearly discussed in the above, there is provided a temperature distribution equalizing structure of a heat roller in a laser printer which is capable of preventing temperature on both ends of the heat roller from being decreased and simultaneously for preventing a halogen lamp from being inclined on the interior of the hear roller, by forming first and second through holes on a pair of bearings on both ends of the heat roller and a gear on the one end of the heat roller to thereby allow the halogen lamp to pass through such that the remaining portions of the bearings and the gear are each closed.

It will be apparent to those skilled in the art that various modifications and variations can be made in a temperature distribution equalizing structure of a heat roller in an image forming device such as a laser printer of the present invention without departing from the spirit or scope of the invention. Thus, it is intended that the present invention covers the modifications and variations of this invention provided they come within the scope of the appended claims and their equivalents.

What is claimed is:

1. A temperature distribution equalizing structure of a heat roller in a laser image forming device, comprising:

a heater having a cylindrical hollow insulator, a lamp source contained said cylindrical hollow insulator, and two ends connected to and supported by a pair of rods;

a cylindrical hollow heat roller rotating about an axis of said cylindrical hollow insulator, having openings;

a pair of bearing members respectively disposed on either end of said cylindrical hollow heat roller and attached to outer circumferential surface of end portion of said cylindrical hollow heat roller, having a circular plate covering said opening and a first aperture formed on said circular plate, rotating with said cylindrical hollow heat roller; and a gear disposed on outside of said circular plate of one of said bearing members, having at least one protrusion formed on said gear and fixed to said bearing member, having a second aperture, rotating with said bearing member and said cylindrical hollow heat roller about said axis of said cylindrical hollow insulator while said cylindrical hollow insulator is inserted into said first and second aperture with a gap.

2. The structure as claimed in claim 1, said first and second apertures of said bearing members and said gear have a predetermined size to maintain a gap in the range of 0.5–1.5 mm between said aperture and said cylindrical hollow insulator of said heating lamp.

3. The structure as claimed in claim 1, wherein said heater includes a halogen lamp.

4. The structure as claimed in claim 2, wherein said heater includes a halogen lamp.

5. The structure of claim 1, further comprised of said protrusion passing through said circular plate.

6. The structure of claim 1, further comprised of said protrusion attached to attached to inner circumferential surface of end portion of said cylindrical hollow heat roller.

* * * * *